US008661731B2

(12) United States Patent
Lee

(10) Patent No.: US 8,661,731 B2
(45) Date of Patent: Mar. 4, 2014

(54) ELECTRIC DOOR-LOCKING SYSTEM USING A CAM

(75) Inventor: Chul Lee, Incheon (KR)

(73) Assignee: The Korea Development Bank, Yeongdeungpo-Gu, Seoul (KR)

( * ) Notice: Subject to any disclaimer, the term of this patent is extended or adjusted under 35 U.S.C. 154(b) by 0 days.

(21) Appl. No.: 13/322,635

(22) PCT Filed: May 24, 2010

(86) PCT No.: PCT/KR2010/003256

§ 371 (c)(1),
(2), (4) Date: Nov. 28, 2011

(87) PCT Pub. No.: WO2010/137834

PCT Pub. Date: Dec. 2, 2010

(65) Prior Publication Data

US 2012/0073208 A1 Mar. 29, 2012

(30) Foreign Application Priority Data

May 26, 2009 (KR) ..... 10-2009-0045825

(51) Int. Cl.
*E05F 17/00* (2006.01)

(52) U.S. Cl.
USPC ..... 49/116; 49/118

(58) Field of Classification Search
USPC ..... 49/116, 118; 105/333, 339; 296/1, 144, 296/201, DIG. 46
See application file for complete search history.

(56) References Cited

U.S. PATENT DOCUMENTS

| | | | | | |
|---|---|---|---|---|---|
| 4,198,786 | A | * | 4/1980 | Monot | 49/362 |
| 4,605,108 | A | * | 8/1986 | Monot | 477/8 |
| 5,077,938 | A | | 1/1992 | Moreuil | |
| 5,341,598 | A | * | 8/1994 | Reddy | 49/362 |
| 6,009,668 | A | * | 1/2000 | Reddy | 49/280 |
| 6,032,416 | A | * | 3/2000 | Springer et al. | 49/119 |
| 6,094,867 | A | * | 8/2000 | Reddy | 49/280 |
| 6,134,838 | A | * | 10/2000 | Reddy | 49/362 |

(Continued)

FOREIGN PATENT DOCUMENTS

| | | | |
|---|---|---|---|
| JP | 2004-250946 | | 9/2004 |
| KR | 10-0676550 | | 1/2007 |
| KR | 10-2009-0028373 | * | 4/2009 |

OTHER PUBLICATIONS

International Search Report mailed Jan. 3, 2011 for PCT/KR2010/003256.

*Primary Examiner* — Katherine Mitchell
*Assistant Examiner* — Abe Massad
(74) *Attorney, Agent, or Firm* — Heedong Chae; East West Law Group

(57) ABSTRACT

The invention relates to an electric door-locking system to be applied to at least one electric door body that is movable in a sliding manner, and includes forwardly and reversely rotatable screws disposed side by side along a direction in which the electric door body slides at the side of a door frame; a cam assembly provided at a predetermined position of the screws to perform a locking function and an unlocking function; and a sliding unit provided with a locking roller resiliently biased in a direction toward the cam assembly and engaging with the cam assembly to perform the locking function, one end of the sliding unit being rotatably connected to the screw and the other end of the sliding unit being connected to the electric door body.

14 Claims, 22 Drawing Sheets

(56) References Cited

U.S. PATENT DOCUMENTS 6,662,500 B2 * 12/2003 Inage ..... 49/116
6,688,042 B2 * 2/2004 Stojc et al. ..... 49/118
6,718,694 B2 * 4/2004 Stojc et al. ..... 49/362
7,252,179 B2 * 8/2007 Oberleitner ..... 187/335
2012/0011778 A1 * 1/2012 Kong ..... 49/503
2012/0017517 A1 * 1/2012 Lee ..... 49/503

* cited by examiner

ELECTRIC DOOR-LOCKING SYSTEM USING A CAM

CROSS REFERENCE TO RELATED APPLICATION

This application claims the priority of Korean Patent Application No. 10-2009-0045825, filed on May 26, 2009 in the KIPO (Korean Intellectual Property Office). Further, this application is the National Phase application of International Application No. PCT/KR2010/003256, filed on May 24, 2010, which designates the United States and was published in Korean.

BACKGROUND OF THE INVENTION

1. Field of the Invention

The present invention relates, in general, to an electric door lock system using a cam and, more particularly, to an electric door lock system using a cam, which has a simple structure, ensures the reliability of a locking function, reduces a danger of a failure and an operation error, and is easy to fabricate and maintain, saving the cost for the fabrication and maintenance relative to the cost taken in the related art.

2. Description of the Related Art

In case of a railway train, a currently available electric door (auto door) is operated such that when a train arrives at a station, the door is opened and closed for boarding or alighting of passengers following the driver's manipulation of an actuation switch, which is performed by the driver who is seeing the passengers boarding on or alighting from the railway train.

Here, if a passenger or an object gets caught in the door during the closing of the electric door, the electric door cannot be completely closed. In this case, the driver for example is informed of such situation or information through a display or an alarm means, and the driver who recognized the state of the door being not completely closed repeatedly manipulates the actuation switch to open and close the electric door until the electric door is completely closed.

In the meantime, if the railway train is stopped to run owing to a fire, a failure, etc. of the train, or passengers should escape from the train because an emergency situation occurs in the train, the driver should directly manipulate the actuation switch to open the door after checking the state of the railway tracks, or otherwise the passengers should directly manually manipulate a manual opening/closing means, which was mounted in the proximity of the electric door, to open the door.

However, if the situation is that the railway train is running, or the state of the railway tracks is dangerous, or otherwise if nevertheless the situation is not an emergency state, the passengers can open the electric door even with their less effort, a very dangerous situation can be caused. Thus, there is a need for an electric door lock system.

In order to provide a reliable locking function, a conventional electric door lock, which was disclosed in U.S. Pat. No. 5,077,938, includes a locking roller, a locking finger member, a guide finger member, a locking roller slide channel, a roller keeper, a carriage, and the like.

However, the conventional electric door lock having the above-mentioned configuration has a problem of increased cost of fabrication and maintenance because of numerous, complex parts.

SUMMARY OF THE INVENTION

Accordingly, the present invention has been made keeping in mind the above problems occurring in the related art, and the present invention is intended to propose to an electric door lock system which has a simple structure, ensures the reliability of a locking function, reduces a danger of a failure and an operation error, and is easy to fabricate and maintain, saving the cost for the fabrication and maintenance relative to the cost taken in the related art.

In order to achieve the above object, according to one aspect of the present invention, there is provided an electric door lock system adapted to at least one electric door body that is able to slide, the electric door lock system including: a pair of screws capable of rotating forwards and rearwards and disposed parallel with each other in one side of a door frame in the direction in which the door body slides; a cam block disposed on a certain position of the screw and serving to provide lock and unlock functions; and a sliding unit having a locking roller elastically biased towards the cam block and latching onto the cam block, serving to provide a locking function, wherein one end thereof is rotatably connected to the screws and the other end thereof is connected to the door body.

The cam block may include a locking cam latching onto the locking roller to provide a locking function, and an unlocking cam pushing the locking roller away from the cam block to provide an unlocking function.

In addition, the cam block may further include an anti-release nut preventing the cam from being released, and a cam fixing shaft fixing the cam to the screw.

In addition, the cam block may further include an emergency-release cam configured, upon releasing an emergency state, to push the locking roller away from the cam block, wherein the emergency-release cam is operatively connected with an operation wire.

According to the present invention, the electric door lock system may further include a locking switch provided in the door body for checking the locked state of the door body when the door body is closed, and a locking switch pressing part actuated for the sliding unit to operate the locking switch such that a locking signal is generated by the locking switch when the door body is closed.

In addition, the locking switch pressing part may further include a locking switch-pressing roller.

The sliding unit may include: a screw nut rotatably screwed-coupled to the screw such that it is movable in the longitudinal direction of the screw; a screw nut housing externally surrounding and supporting the screw nut; and a locking roller holder connected to one side of the screw nut housing so that one side thereof is connected with the locking switch pressing part.

Here, the screw nut housing may have a space in which the sliding unit is prevented from moving until the screw nut that is moving as the screw rotates is moved to a certain distance.

The sliding unit may further include: a hanger connected with the door body; a guide roller connected to one side of the hanger and coupled to a guide rail formed on a door frame such that it is able to roll along the guide rail; and a link that connects and supports the other side of the hanger and the screw nut housing.

The door body, the locking switch, the screw, the cam block, and the sliding unit may be respectively provided in a pair unit, in which both elements are symmetric with each other, on the door frame. Here, the opposite screws may respectively have threads extending opposite to each other.

In addition, the electric door lock system may further include a closing switch provided in the door body so as to generate a signal indicative of the closed state of the door body when the door body was closed.

In another aspect of the present invention, there is provided an electric door having the electrical door lock system having the above-mentioned configuration.

As set forth before, the electric door lock system has a simple structure, ensures the reliability of a locking function, reduces a danger of a failure and an operation error, and is easy to fabricate and maintain, saving the cost for the fabrication and maintenance relative to the cost taken in the related art.

BRIEF DESCRIPTION OF THE DRAWINGS

The above and other objects, features and advantages of the present invention will be more clearly understood from the following detailed description when taken in conjunction with the accompanying drawings, in which.

DETAILED DESCRIPTION OF THE INVENTION

Figure 1:
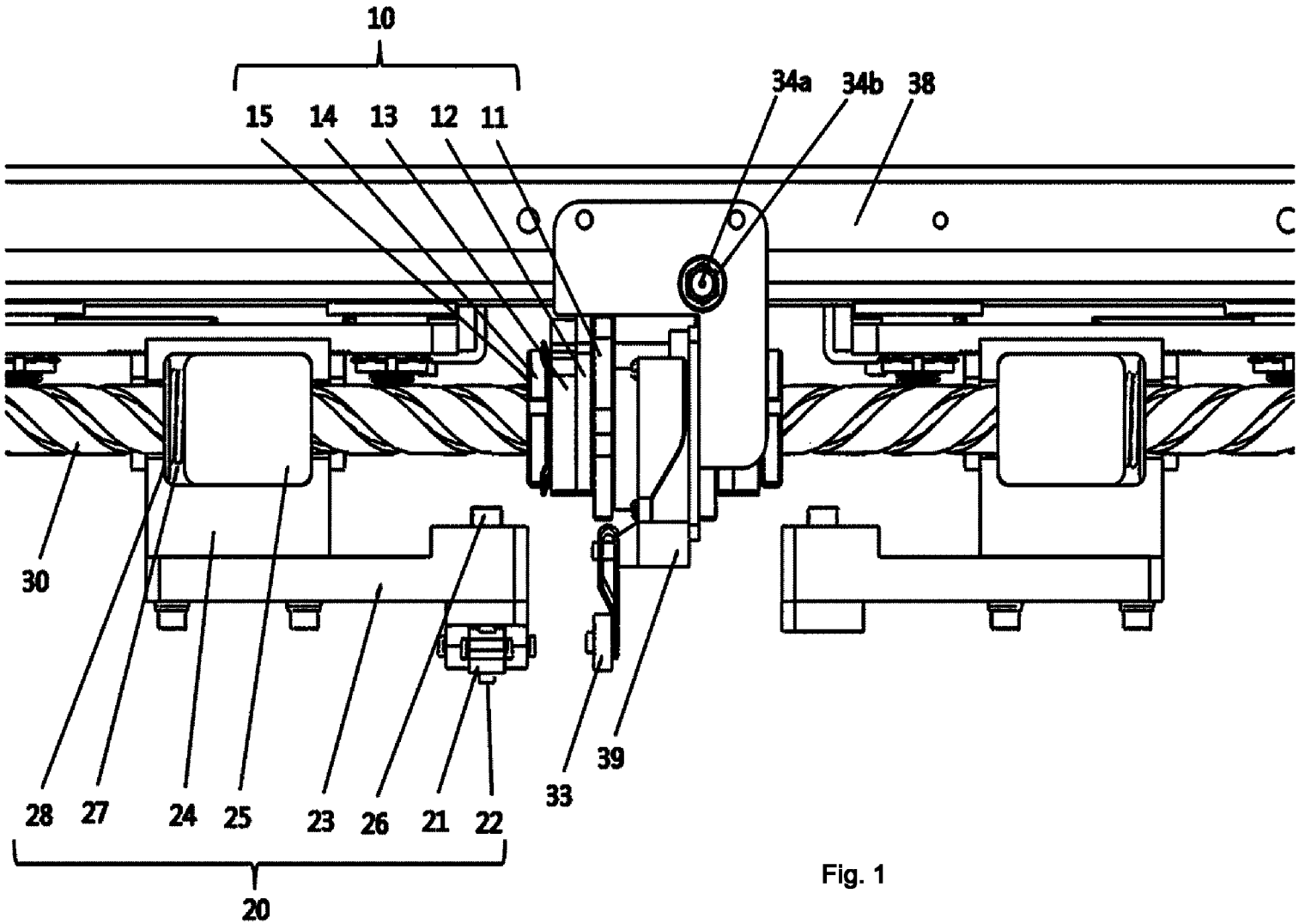
FIG. 1 is a plan view showing an electric door lock system according to an embodiment of the present invention when it is being closed.

The specific structures and functional description will be only provided for the purpose of illustration of the embodiments according to the concept of the invention, so that the embodiments of the invention may be embodied in many different forms and should not be construed as being limited to the embodiments set forth herein.

The embodiments according to the concept of the invention may be changed to diverse forms, so that the invention will be described and illustrated with reference to specific embodiments. However, it should be understood that the embodiments according to the concept of the invention is not intended to limit to the specific embodiments disclosed, but they include all the modifications, equivalences, and substitutions, which are included in the scope and sprint of the invention.

It will be understood that although the terms "first," and/or "second," etc. may be used herein to describe various elements, these elements should not be limited by these terms. These terms are only used to distinguish one element from another element. Thus, a first element discussed below could be termed a second element and vice versa without departing from the nature of the present invention.

It will be understood that when an element is referred to as being "connected or coupled" to another element, it can be directly connected or coupled to the other element or intervening elements may be present therebetween. In contrast, when an element is referred to as being "directly connected or coupled" to another element, there are no intervening elements present. Other expressions such as "between" and "directly between," or "adjacent" or "directly adjacent" should be understood in a similar manner.

The terminology used herein is for the purpose of describing particular embodiments only and is not intended to limit the invention. As used herein, the singular forms "a", "an" and "the" are intended to include the plural forms as well, unless the context clearly indicates otherwise. It will be further understood that the terms "comprises" and/or "comprising," or "includes" and/or "including," when used in this specification, specify the presence of stated features, regions, integers, steps, operations, elements and/or components, but do not preclude the presence or addition of one or more other features, regions, integers, steps, operations, elements, components and/or groups thereof.

Unless otherwise defined, the meaning of all terms including technical and scientific terms used herein is the same as that commonly understood by one of ordinary skill in the art to which the present invention belongs. It will be further understood that terms, such as those defined in commonly used dictionaries, should be interpreted as having a meaning which is consistent with their meaning in the context of the relevant art and the present disclosure, and will not be interpreted in an idealized or overly formal sense unless expressly so defined herein.

The invention will now be described with reference to the accompanying drawings, in which exemplary embodiments of the invention are shown. The same reference numerals indicated in the drawings refer to similar elements throughout.

As shown in FIGS. 1 to 22, an electric door lock system according to an embodiment is adapted to at least one electric door body (not shown) that is able to slide, and the electric door lock system includes: a pair of screws 30 that is capable of rotating forwards and rearwards and disposed parallel with each other in one side of a door frame in the direction in which the door body slides; a cam block 10 that is disposed on a certain position of the screw and serves to provide lock and unlock functions; and a sliding unit 20 having a locking roller 26 elastically biased towards the cam block and latching onto the cam block, thereby serving to provide a locking function, wherein one end thereof is rotatably connected to the screws and the other end thereof is connected to the door body. The cam block 10 may be mounted on a central portion or one end of the screw 30. The cam block 10 may include a locking cam 13 latching onto the locking roller to provide a locking function, and an unlocking cam 12 pushing the locking roller away from the cam block to provide an unlocking function. In addition, the cam block 10 may further include an emergency-release cam 11 which is configured, upon releasing an emergency state, to push the locking roller 26 away from the cam block, wherein the emergency-release cam 11 is operatively connected with an operation wire 34*a*. In addition, the cam block 10 may further include an anti-release nut 14 which prevents the cam from being released, and a cam fixing shaft 15 which fixes the cam to the screw.

Figure 5:
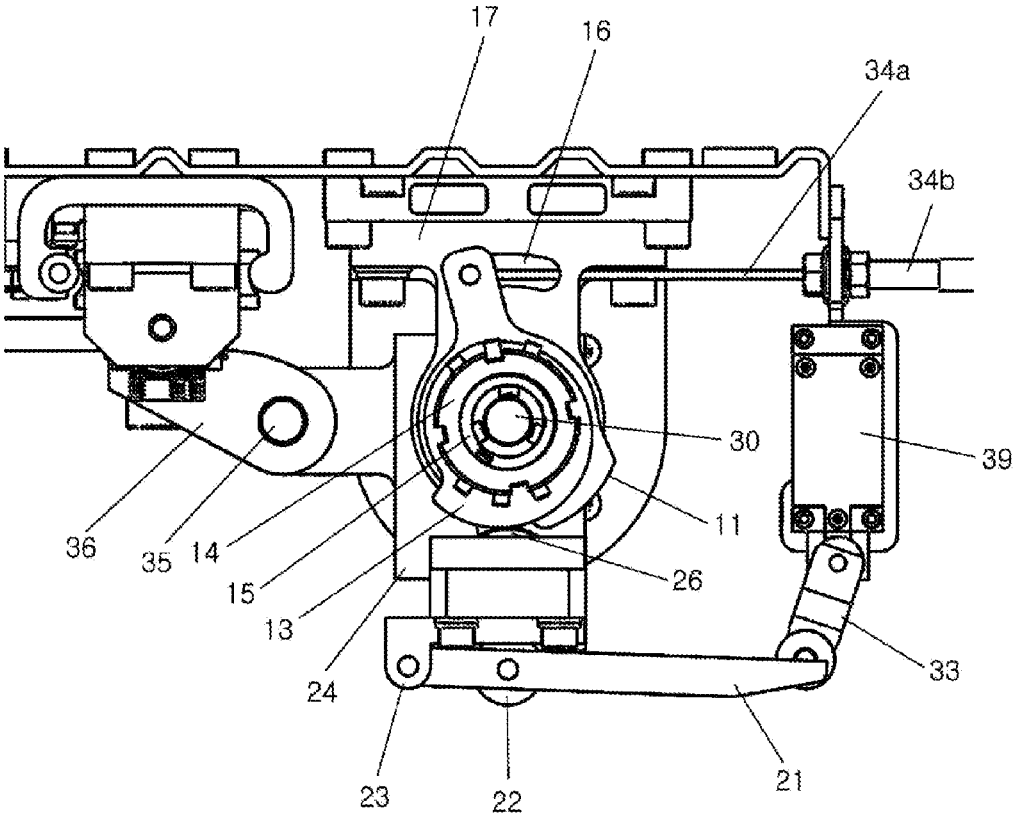
FIG. 5 is a side view showing the electric door lock system of FIG. 4 when it is being closed.
Figure 6:
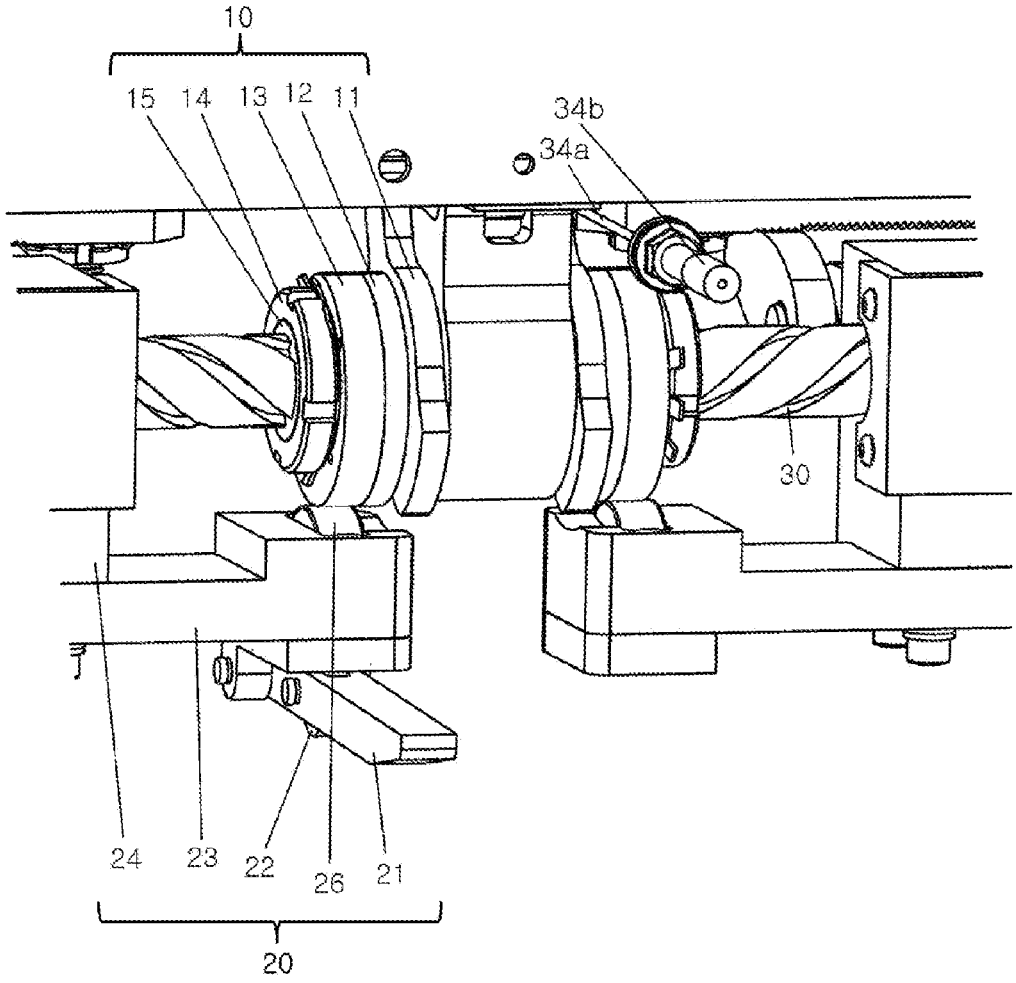
FIG. 6 is a perspective view showing the electric door lock system of FIG. 4 when it is being closed.

According to the electric door lock system of the present invention, when the screw 30 rotates in a forward or rearward direction by a motor 31, the door body is closed or opened based on the forward or rearward rotation of the screw 30. That is, while the door body is being closed as shown in FIG. 6, the locking roller 26 meets the locking cam 13 of the cam block 10, and the locking cam 13 that rotates at the same angle as the screw rotates and further pushes the locking roller 26 perpendicular to and away from the door frame 38. When the locking roller 26 passes beyond the locking cam 13 and reaches the point where it meets the unlocking cam 12, the locking roller 26 (which is configured to be elastically biased towards the cam block 10) is released from the force exerted by the locking cam 13 and is biased (restored) again towards the door frame 38 by the elastic force so as to cooperate with (latch onto) the locking cam 13, thereby being in a locked position (see FIGS. 4 to 9).

Figure 7:
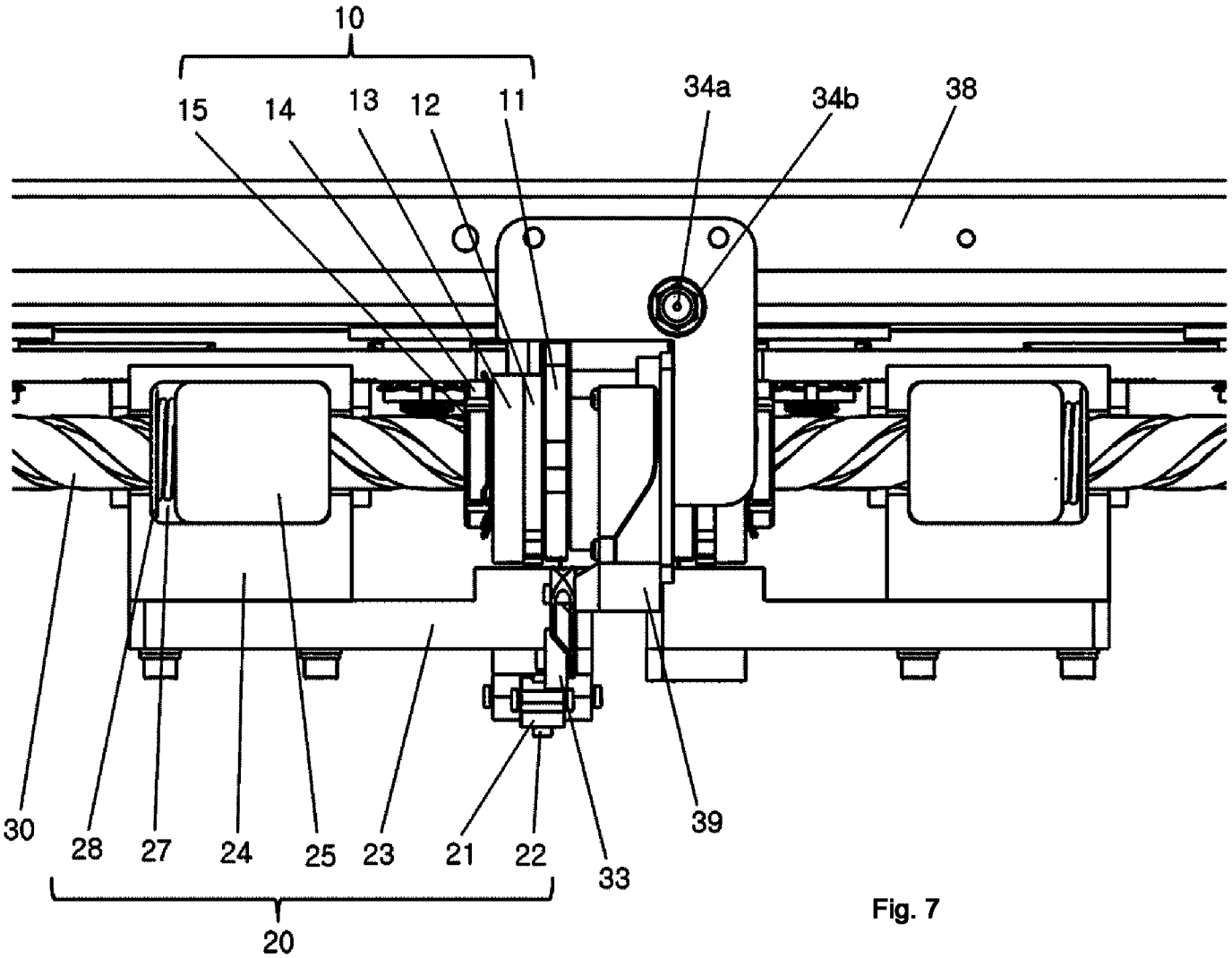
FIG. 7 is a plan view showing the electric door lock system when it was completely closed so that the locking roller completely latched onto a locking cam of the cam block and a locking switch pressing part pushed the locking switch.
Figure 8:
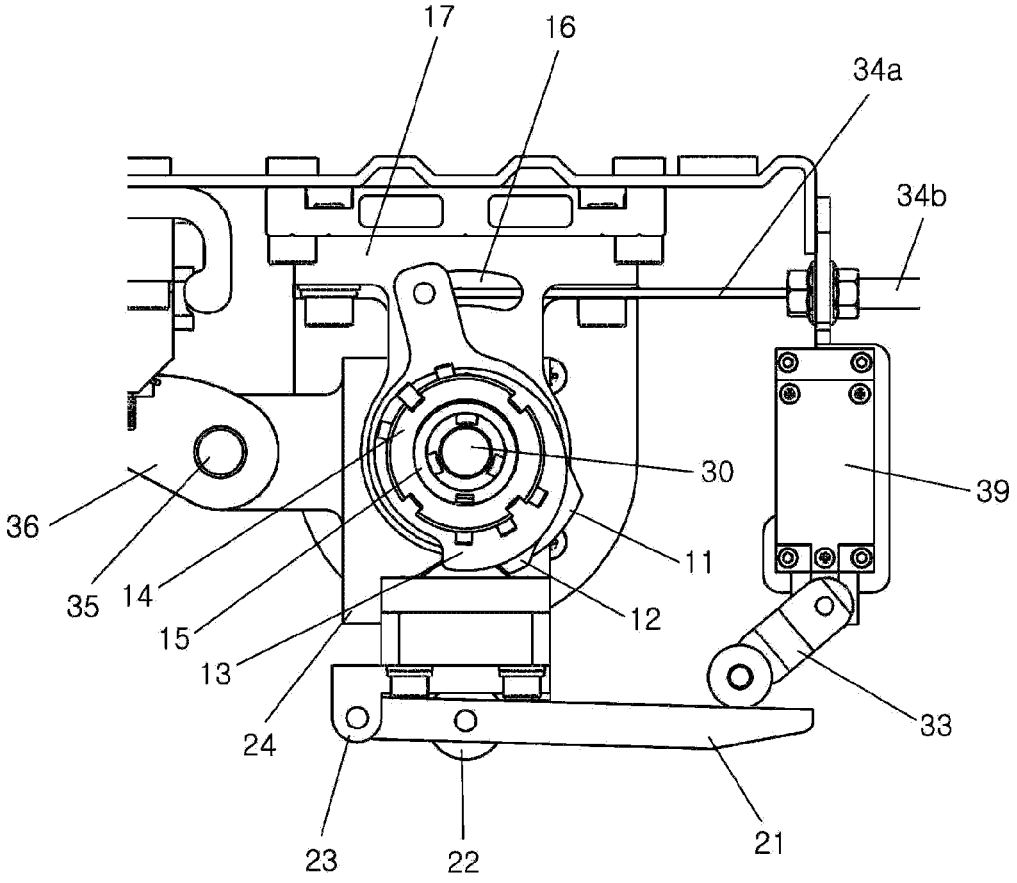
FIG. 8 is a side view showing the electric door lock system of FIG. 7 before it is completely closed.

As shown in FIG. 1, the locking switch 33 may be coupled to a locking switch connection block 39 which is connected to the upper portion of the door frame 38. Since the locking switch 33 is configured as a sensor that is actuated by a locking switch pressing part 21, that is, it is actuated by the pressing action, so as to generate a signal indicative of the locked state, it is preferred that the locking switch is rotatably coupled to the locking switch connection block 39. The locking switch pressing part 21 may be provided in a planar shape. Referring to FIGS. 3 and 8, it can be seen that when the locking switch 33 is pressed down by the locking switch pressing part 21, it is pressed down at a certain angle on the locking switch connection block 39 to generate a signal. Of course, it is merely an exemplary embodiment. That is, while the present embodiment has illustrated the construction in which when the door body is closed, the locking switch pressing part 21 is moved in association with the closing operation so as to actuate the locking switch 33, alternative embodiment is possible in which the locking switch 33 is disposed as e.g. a proximity sensor at the position closer to the door frame 38 than the position shown in FIGS. 1 to 9, so that when the locking switch pressing part 21 approaches the locking switch 33, the locking switch can then only generate a locking signal. However, so long as when the door body is closed, the reliability of the locking function can be secured, any method may be adapted.

When the electric door lock system of the present invention is closed, the locking switch pressing part 21 is restored as the locking roller 26 is being restored (that is, as the locking switch pressing part 21 is being elastically biased towards the cam block 10), so as to actuate the locking switch 33. Thus, the locking switch pressing part allows the locking switch 33 to generate the locking signal, which in turn is transmitted to a user, thereby completing the closing stroke of the door body.

The screw 30 receives the practical driving force from the motor 31 and transmits it to the electric door body in order to allow the door body to be opened or closed.

In the present embodiment, since a pair (set) of electric door bodies is provided, a pair of screws 30 is also provided. Here, since the pair of electric door bodies is opened or closed in opposite directions to each other, the pair of screws has threads that extend in opposite directions to each other. That is, in FIG. 22, the left side screw 30 has the right-side thread, whereas the right side screw 30 has the left-side thread. Since such screws 30 transmit a practical driving force to the electric door body, they are connected to a drive shaft of the motor 31 in order to rotate forwards or rearwards. For reference, opening/closing of the door may be manually controlled by a user, or otherwise may be automatically controlled.

The cam block 10 includes the emergency-release cam 11 which is connected with the operation wire 34*a* so as to push the locking roller 26 in an emergency state, thereby releasing the locked state, the unlocking cam 12 which when the screw 30 rotates in the direction in which the door body is opened, rotates at the same angle as the screw 30 so as to push the locking roller 26, thereby releasing the locked state, and the locking cam 13 which when the screw 30 rotates in the direction in which the door body is closed, rotates at the same angle as the screw 30, and which when the screw nut 25 reaches the end position in the direction in which the sliding door is closed, overlaps with one side of the locking roller 26, thereby performing the locking operation. In addition, the cam block 10 includes the anti-release nut 14 which prevents the emergency-release cam 11, the unlocking cam 12, and the locking cam 13 from being released, the cam fixing shaft 15 which fixes the cams, and a cam housing 17 having a long hole 16 which allows the emergency-release cam to move at a certain angle.

Figure 22:
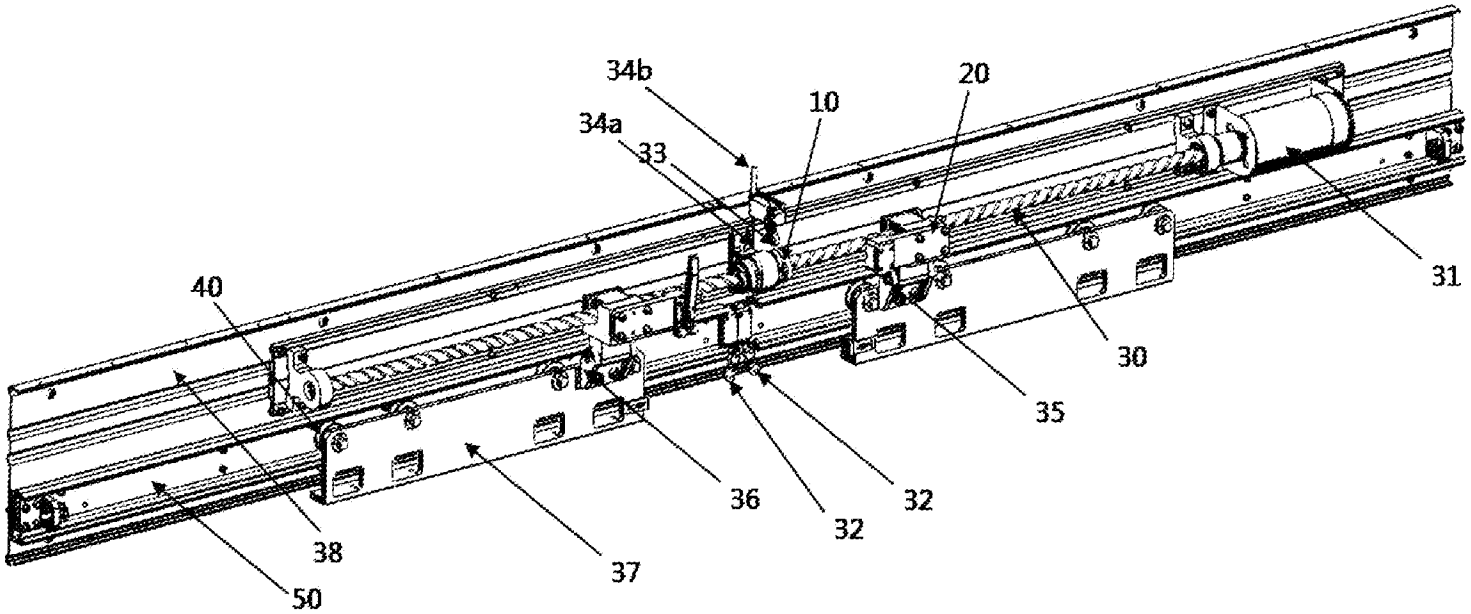
FIG. 22 is a perspective view showing the entire electric door lock system according to the present invention.

More specifically, the emergency-release cam 11 is disposed at an innermost position of the cam block 10, and is only actuated by the operation wire 34*a* irrespective of the rotation of the screw 30. As shown in FIGS. 3 and 22, when the operation wire 34*a* is pulled when a vehicle is in an emergency state, one side of the emergency-release cam 11 connected with the operation wire 34*a* is moved by a certain distance along the long hole 16 of the cam housing 17 so that it is rotated at a certain angle. Here, a projected portion of the emergency-release cam 11 pushes the locking roller 26 away from the cam block 10, so that the locking roller 26 can be released from the locked position where it latched onto the locking cam 13.

The long hole 16 is provided such that as shown in FIGS. 3 and 22, one side of the emergency-release cam 11 connected with the operation wire 34*a* in the cam housing 17 completely pushes out the locking roller 26 in the position where it does not affect the locking roller 26, to the position where it can release the locked state. That is, the length or size of the long hole 16 is determined within a range in which the emergency-release cam 11 can operate on the locking roller 26 so as to allow it to move between the locked position and the unlocked position.

The locking cam 13 rotates at the same angle as the angle at which the screw 30 rotates, so that it serves to lock the locking roller 26 while cooperating with (latching onto the side of) the locking roller in the direction perpendicular to the direction in which the sliding unit 20 advances. In this case, since the locking roller 26 and the locking cam 13 latch with each other in the direction perpendicular to the direction in which the door body moves, even when passengers try to open the door body, the door body can stay in the locked state.

Similar to the locking cam 13, the unlocking cam 12 rotates at the same angle as the angle at which the screw 30 rotates, so that it serves to allow the locking roller 26 to move out of its locked state with respect to the locking cam 13 while pushing the locking roller 26 away from the cam block 10 (in the direction F shown in FIGS. 10 to 12) when the door body starts to perform an opening operation.

The anti-release nut 14 is mounted in the emergency-release cam 11, the locking cam 13, and the unlocking cam 12 so as to prevent them from being released.

The cam fixing shaft 15 is mounted between the screw 30 and the inside of the emergency-release cam 11, the locking cam 13, and the unlocking cam 12 so as to fix the cams.

In the meantime, the sliding unit 20 is a unit wherein one end thereof is rotatably connected to the screw 30 and the other end thereof is connected to the door body, serving to open or close the door body following the transmission of the rotating power of the screw 20 that is rotating to the door body. Particularly, the sliding unit 20 of the present embodiment advantageously has a very simple configuration and improved reliability of the operation because in addition to detailed elements described below, the locking switch pressing part 21 that actuates the locking switch 33 and the locking roller 26 serving to provide a locking function are integrated with each other.

More specifically, according to the present embodiment, since most parts other than the locking switch 33, the screw 30 and the cam block 10 are integrated with the sliding unit 20, the door lock system may have a simple structure, ensure the reliability of a locking function, reduce a danger of a failure and an operation error, and be easy to fabricate and maintain, saving the cost for the fabrication and maintenance relative to the cost taken in the related art.

The sliding unit 20 may further include a screw nut 25 rotatably screwed to the screw 30 such that it is movable in the longitudinal direction of the screw 30, a screw nut housing 24 that externally partially surrounds and supports the screw nut 25, a spring 27 which allows the screw nut 25 to move to a certain distance in the screw nut housing 24, a spring support 28 which prevents the spring from being dislocated from its position, and a locking roller holder 23 wherein one end is connected with the screw nut housing 24 and the other end is with the locking switch pressing part 21. The locking roller holder 23 may include the locking roller 26 that interacts with the cam block 10 to provide a locking function. In addition, the sliding unit 20 may further include the locking switch pressing part 21 which is connected to one side of the locking roller holder 23 to actuate the locking switch 33, a link which connects the sliding unit 20 to the door body, a hinge 35, and a hanger 37.

The screw nut 25 is screw-coupled with the screw 30. Thus, as the screw 30 rotates, the screw nut 25 connected to the side of the door body is movable in the longitudinal direction of the screw 30. Since the screw nut 25 is movable in the longitudinal direction of the screw 30, the door body connected with the screw nut 25 can be actuated.

The screw nut housing 24 is an element that externally surrounds the screw nut 25 and to which the locking roller holder 23 and the link 36 are connected. Further, a space may be further provided between the screw nut 25 and the screw nut housing 24, so that the screw nut 25 can move therein in the direction, along which the door body slides, with respect to the screw nut housing 24. The spring 27 and the spring support 28 are included in the space, so that even when the screw 30 and the cam block 10 concurrently rotate at a certain angle so that the cam block is moved by a certain distance when an opening operation is started, the locking roller holder 23 including the locking roller 26 and the screw nut housing 24 do not move in the direction along which the door body slides. Thus, the unlocking cam 12 pushes (presses) the locking roller 26, allowing the locking function performed between the locking roller 26 and the locking cam 13 to be smoothly released. Here, the space is not essentially formed larger, but is sufficient so long as it is formed such that the screw nut 25 is not fixed in the screw nut housing 24, and the unlocking cam 12 can push the locking roller 26 so that the locking roller is moved out of its locked position.

As described before, the locking switch pressing part 21 serves to generate a locking signal by the locking switch 33 following the actuation of the locking switch 33 when the door body is closed. A locking switch pressing roller 22 may be further provided in order to allow the locking switch pressing part 21 to smoothly interact with the locking roller 26. The locking switch pressing part 21 may be provided such that it is elastically biased towards the locking switch 33. Since such a structure may be simply provided such that an elastic spring (not shown) which is mountable to the locking switch pressing part 21 elastically moves the locking switch pressing part 21 towards the locking switch 33, it is omitted in the drawings.

Referring to FIG. 22, the door body may be further provided with a closing switch 32 that generates a signal indicative of a closed state of the door body when the door body was closed.

The closing switch 32 is a sensor that simply generates a signal indicative of the state in which the door body was closed. The closing signal by the closing switch 32 is generated and transmitted to a user before the locking signal by the locking switch 33 is not generated. Consequently, the user receives both the closing signal by the closing switch 32 and the locking signal by the locking switch 33. Then, after both the closing signal and the locking signal haven been received, the motor 31 for driving the screw 30 is stopped to operate, thereby completing the closing stroke.

In the embodiment of the invention, the door frame 38 is a mounting plate to which the door body (not shown) is slidably fixed. The door frame may be made from a metal frame in order to secure certain degree of strength.

Subsequently, a description will be made of the operation of the electric door lock system while exemplifying a railway train.

First, the closing operation of the electric door lock system will be described with reference to FIGS. 1 to 9.

Figure 2:
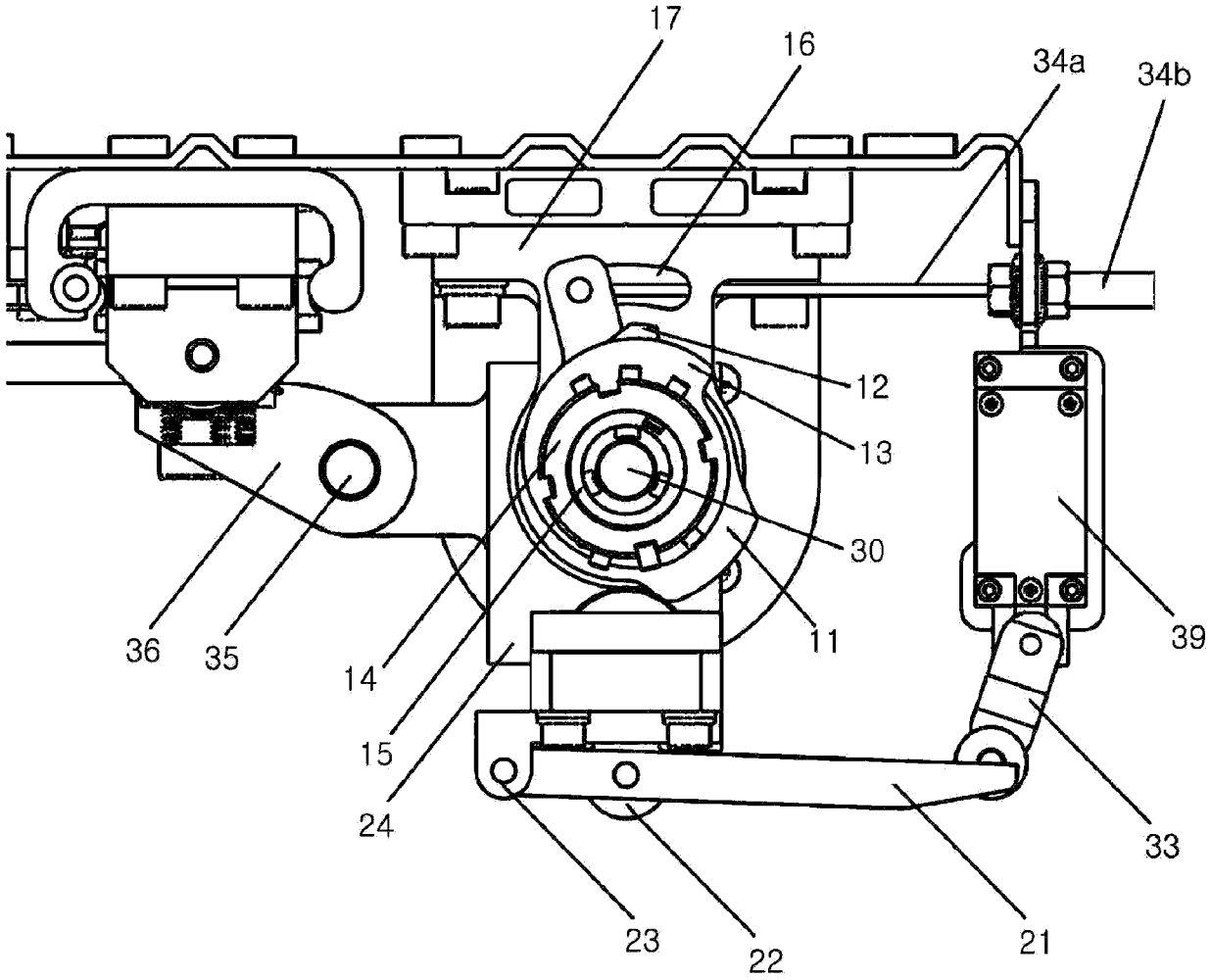
FIG. 2 is a side view showing the electric door lock system of FIG. 1 when it starts to perform a closing operation.
Figure 3:
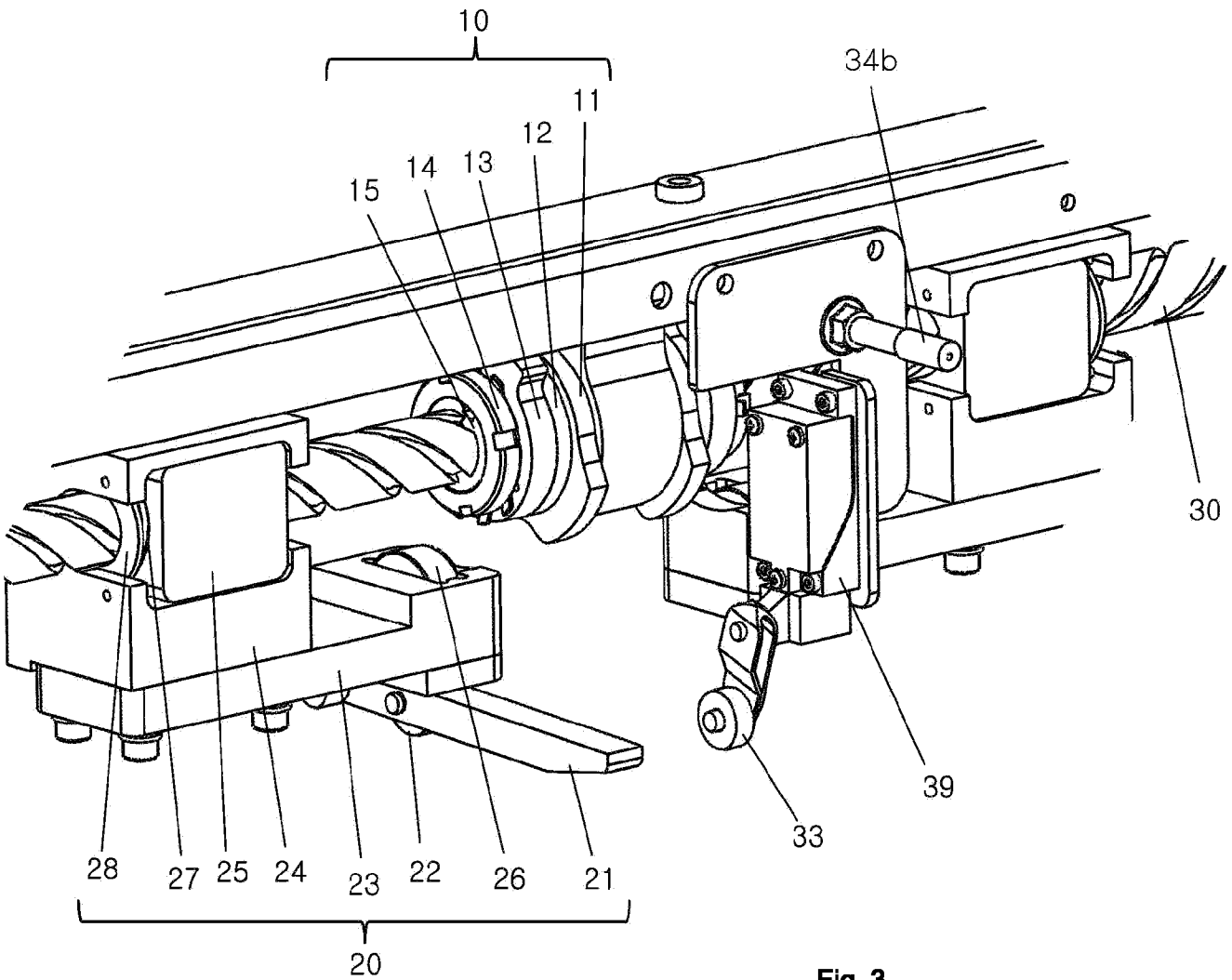
FIG. 3 is a perspective view showing the electric door lock system of FIG. 1 when it starts to perform the closing operation.
Figure 4:
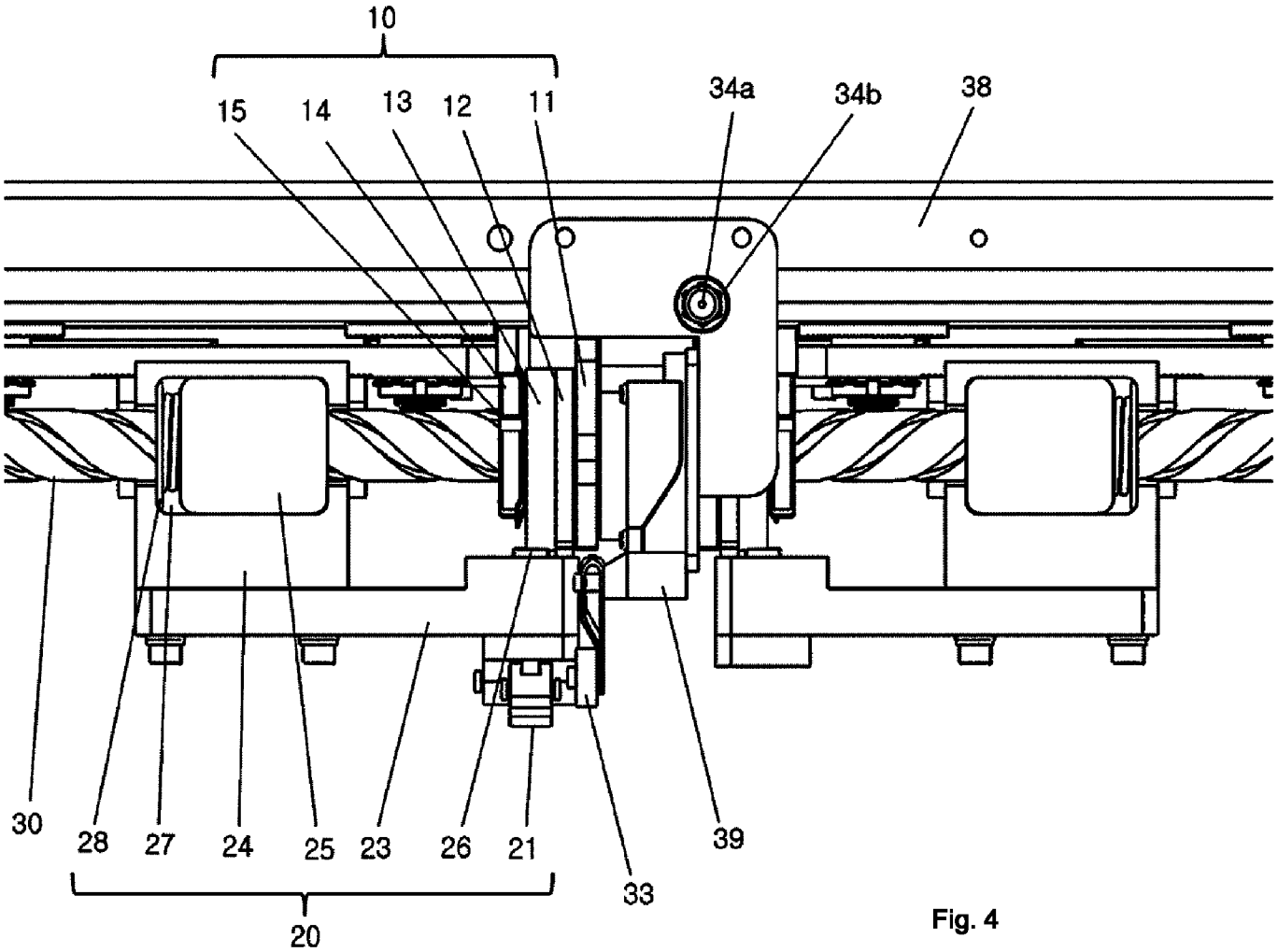
FIG. 4 is a plan view showing the electric door lock system when it is being closed so that a locking roller meets a cam block.
Figure 9:
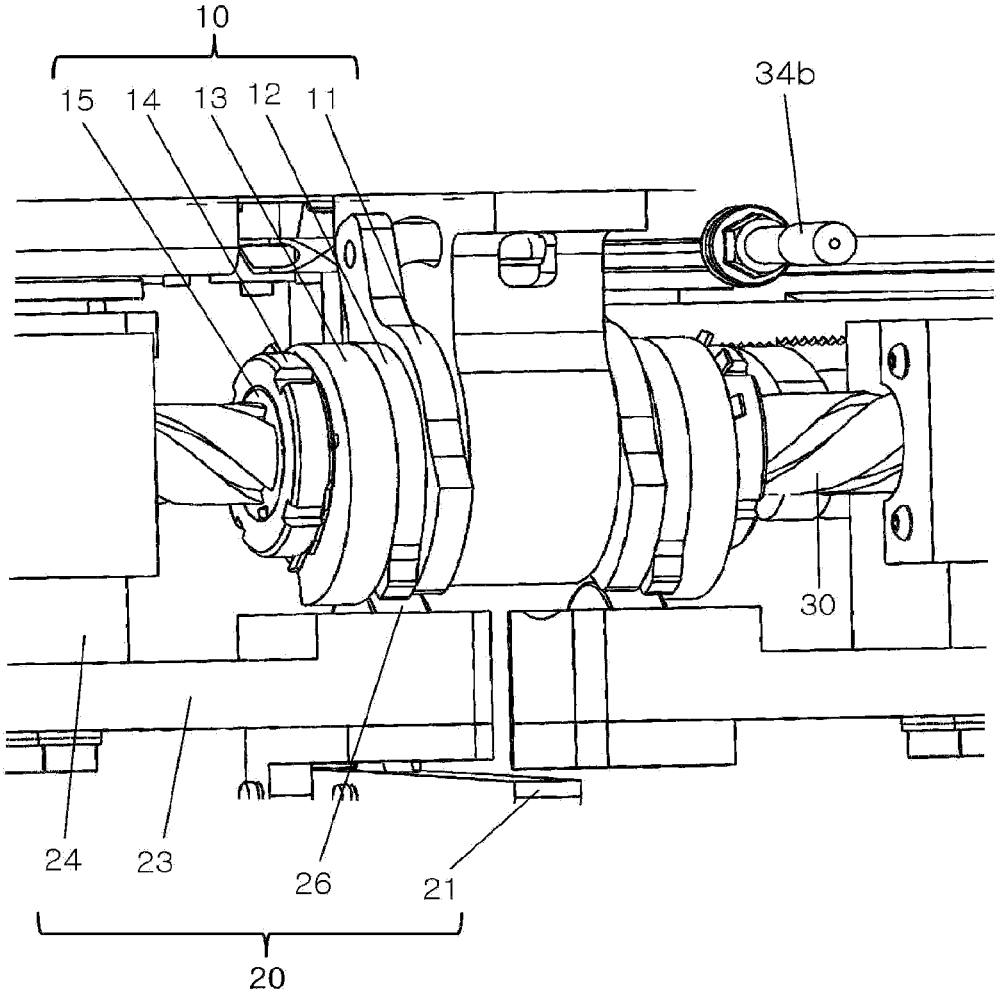
FIG. 9 is a perspective view showing the electric door lock system of FIG. 7 when it was completely closed.

FIGS. 1 to 3 are views showing the electric door lock system according to an embodiment of the present invention when it starts to perform the closing operation. FIGS. 4 to 6 are views showing the electric door lock system when it is being closed so that the locking roller meets the cam block. FIGS. 7 to 9 are views showing the electric door lock system when it was completely closed so that the locking roller completely latched onto the locking cam of the cam block and the locking switch pressing part pushed the locking switch.

When the screw 30 rotates in the forward or reverse direction by the operation of the motor 31, the door body is opened or closed following the forward or reverse rotation of the screw 30.

When the door body is being closed as shown in FIG. 6, the locking roller 26 meets the locking cam 13 of the cam block 10 and the locking cam 13 that will rotate at the same angle as the screw 30 rotates and further pushes the locking roller 26 in the direction perpendicular to and away from the door frame 38. When the locking roller 26 passes beyond the locking cam 13 and reaches the point where it meets the unlocking cam 12 as shown in FIG. 9, the locking roller 26 (which is configured to be elastically biased towards the cam block 10) is released from the force exerted by the locking cam 13 and is biased (restored) again towards the door frame 38 by the elastic force so as to cooperate with (latch onto) the locking cam 13, thereby being in a locked position (see FIGS. 4 to 9). Here, the locking switch pressing part 21 is restored as the locking roller 26 is restored, so as to actuate the locking switch 33. Thus, the locking signal is generated by the locking switch 33, and is transmitted to a user, thereby completing the closing stroke of a door. Of course, since this state is obtained in the process of finally checking the locked state, it is the state in which the closing signal was already transmitted from the closing switch 32 before the locking signal is not generated. Like this, when the closing signal by the closing switch 32 and the locking signal by the locking switch 33 are transmitted to the user's control system, the closing stroke of the door is then only completed. Here, since the locking roller 26 already cooperated with (latched onto) the locking cam 13 and was disposed in a locked state, even though the passengers try to open the door body, the door body is still held in the locked state so that the door body cannot be opened.

Next, the opening operation of the electric door lock system of the present invention will be described with reference to FIGS. 10 to 18.

Figure 10:
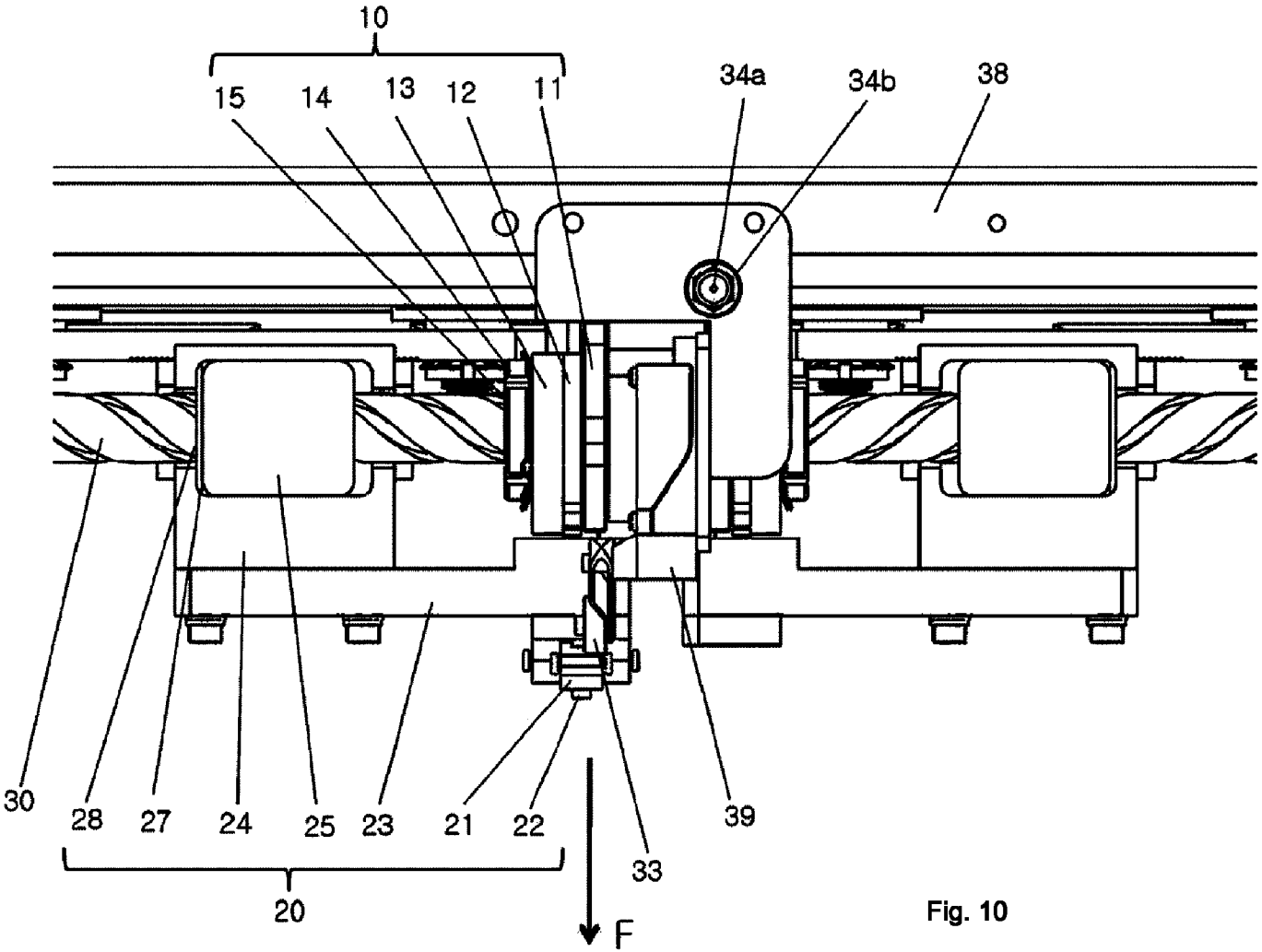
FIG. 10 is a plan view showing the electric door lock system when it starts to perform an opening operation.
Figure 11:
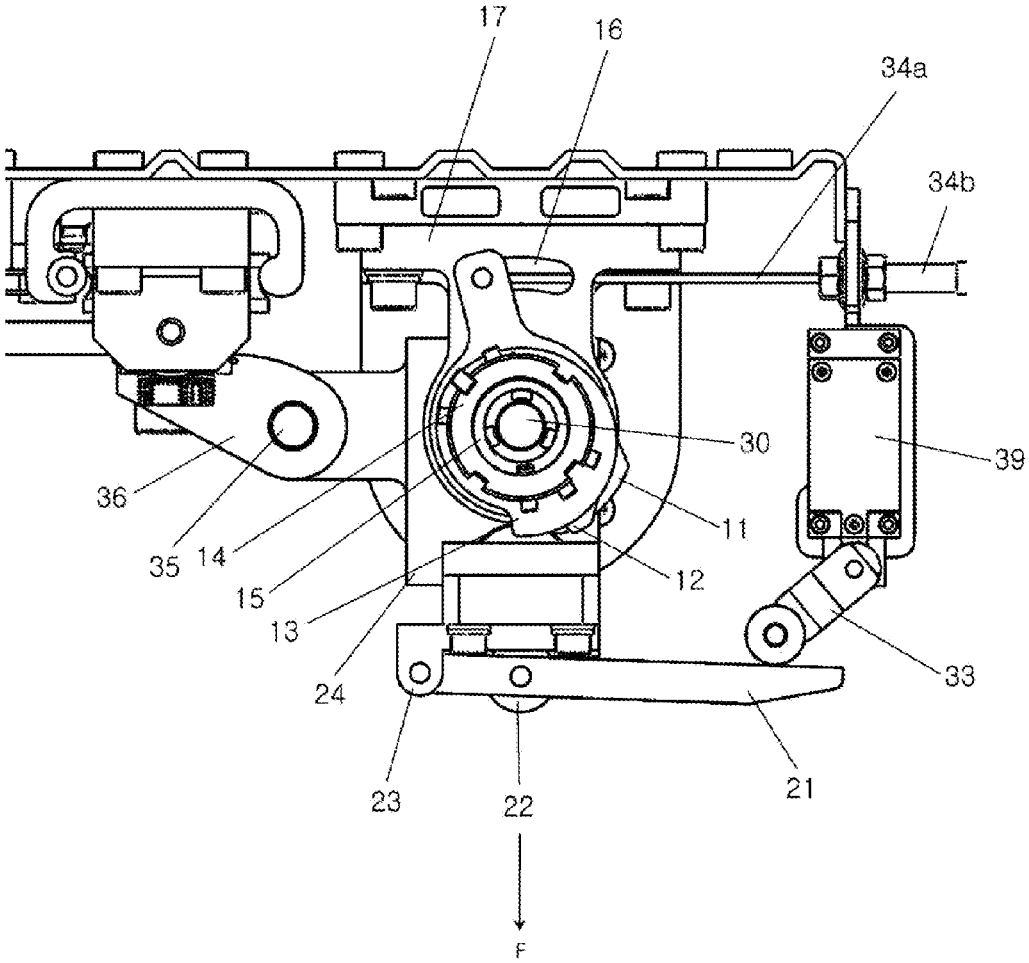
FIG. 11 is a side view showing the electric door lock system of FIG. 10 when it starts to perform the opening operation.
Figure 12:
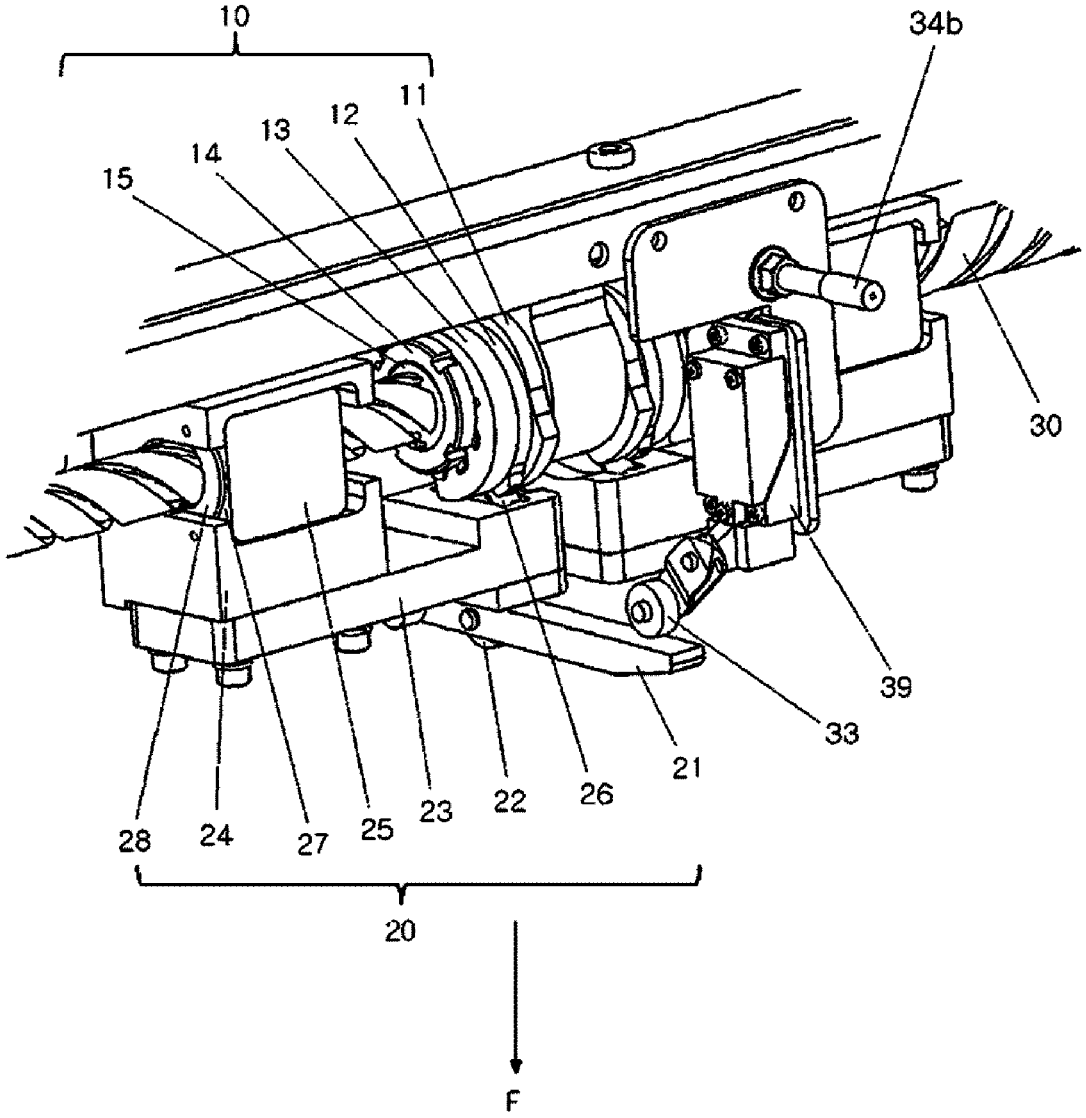
FIG. 12 is a perspective view showing the electric door lock system of FIG. 10 when it starts to perform the opening operation.
Figure 13:
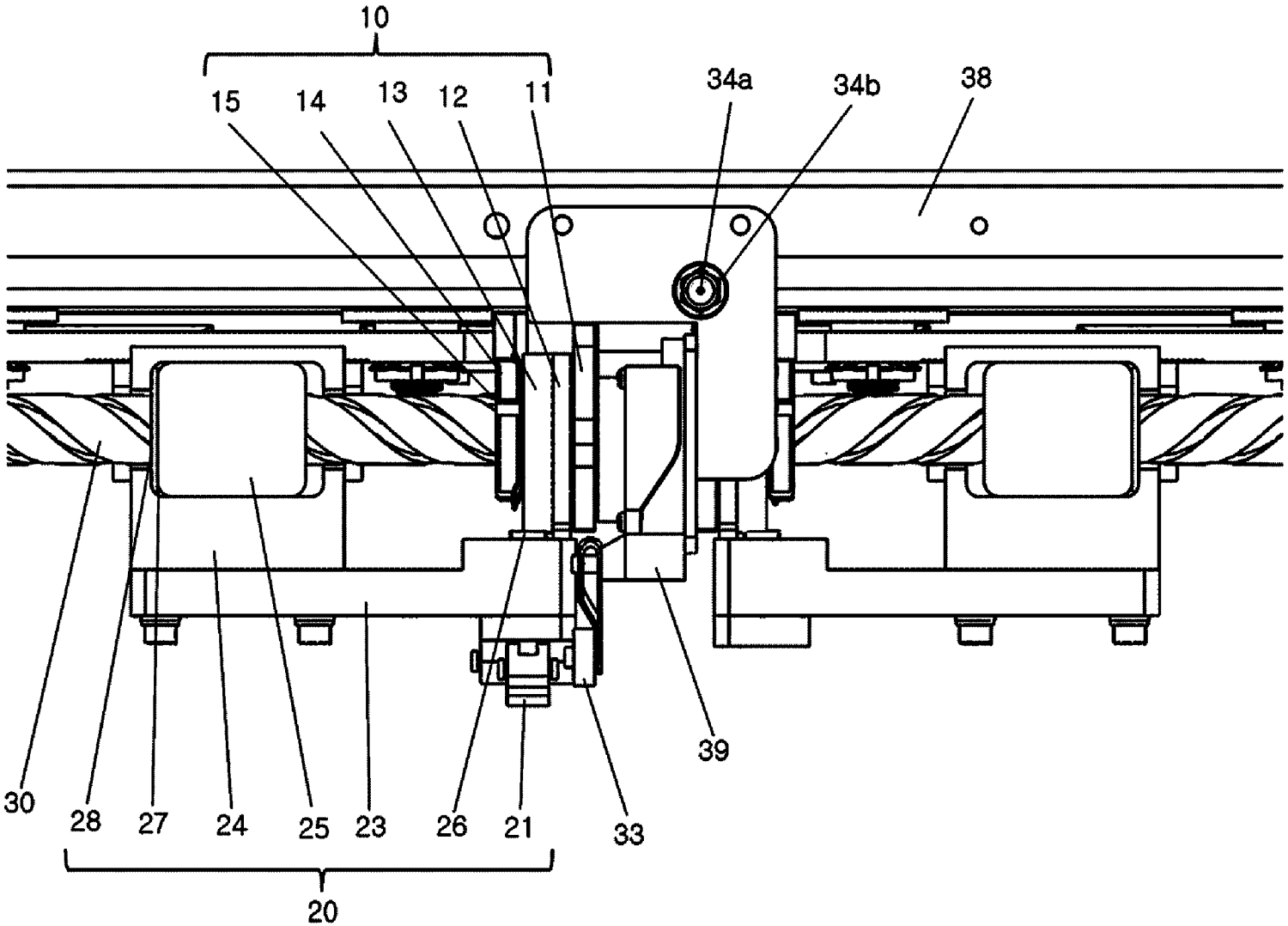
FIG. 13 is a plan view showing the electric door lock system being opened so that the locking roller is just unlatched from the locking cam of the cam block.
Figure 14:
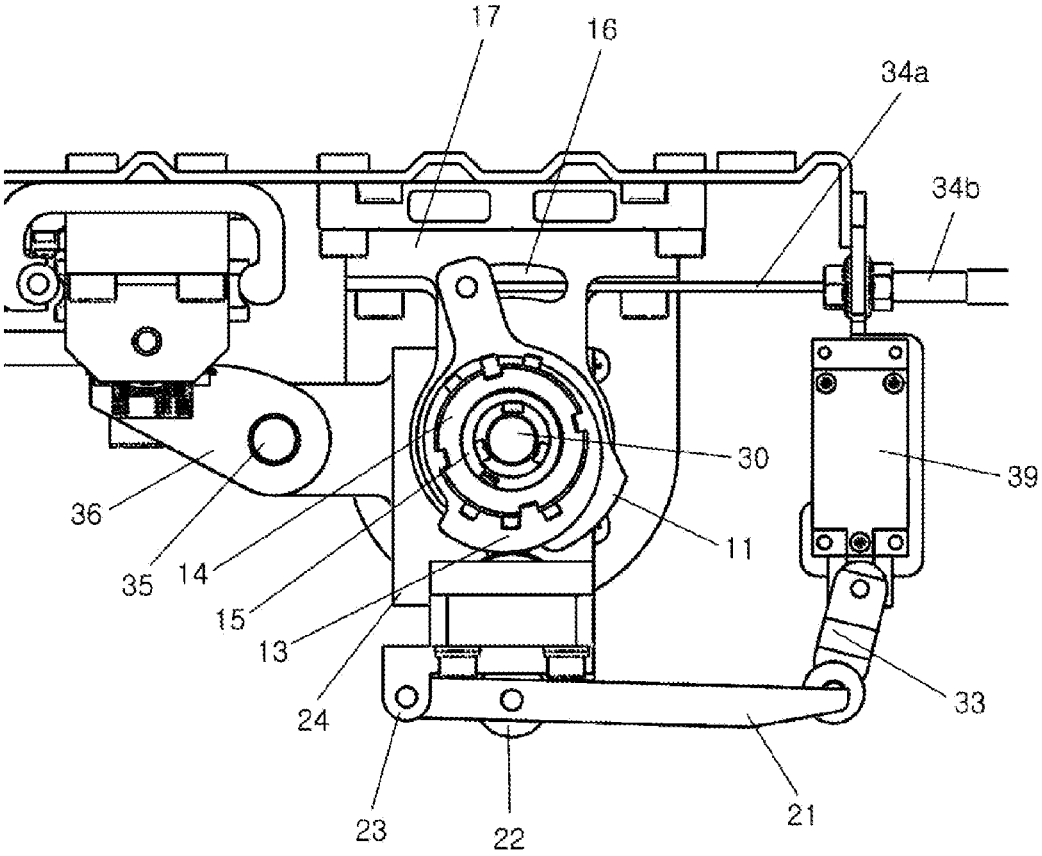
FIG. 14 is a side view showing the electric door lock system of FIG. 13 when it is being open.
Figure 15:
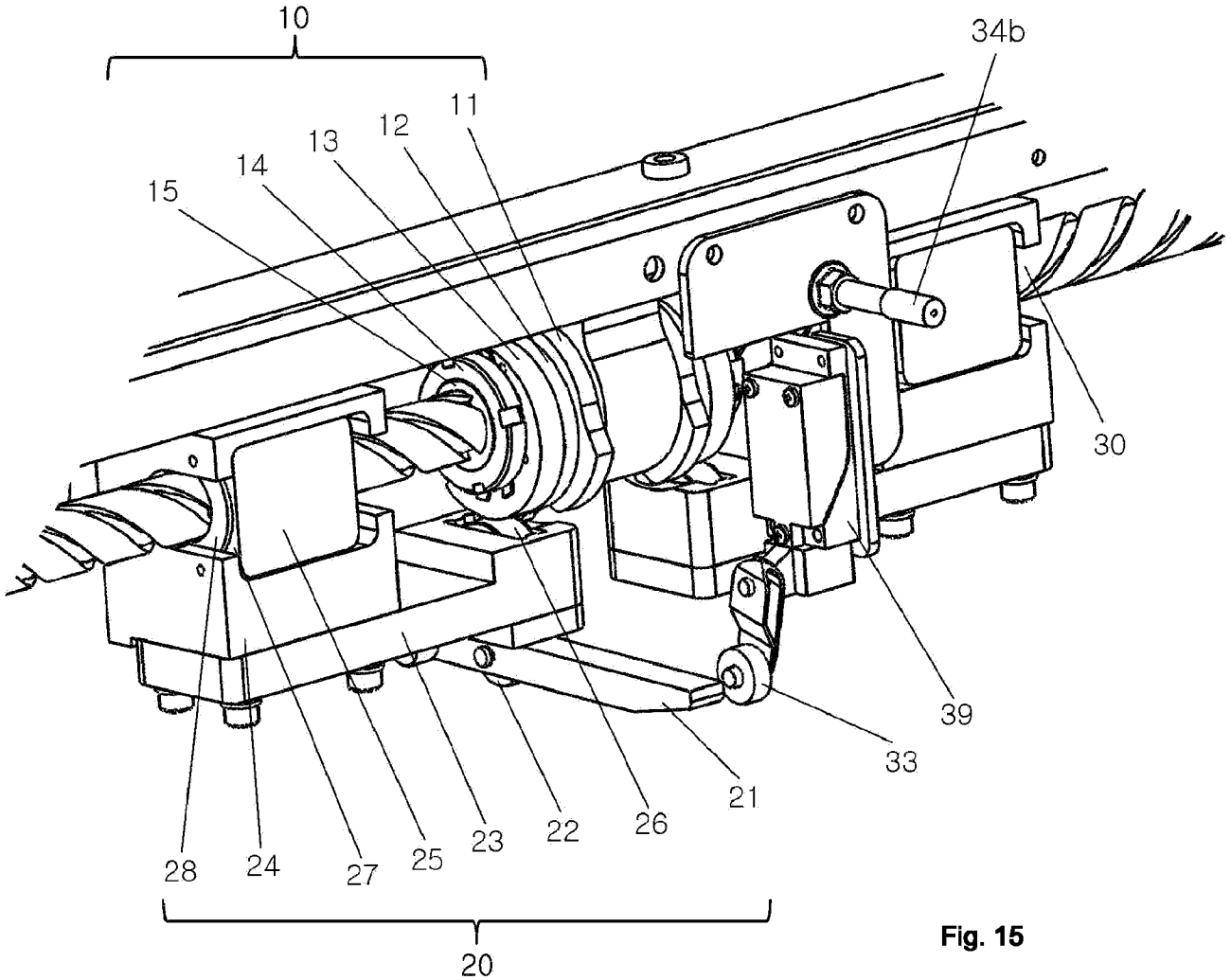
FIG. 15 is a perspective view showing the electric door lock system of FIG. 13 when it is being opened.
Figure 16:
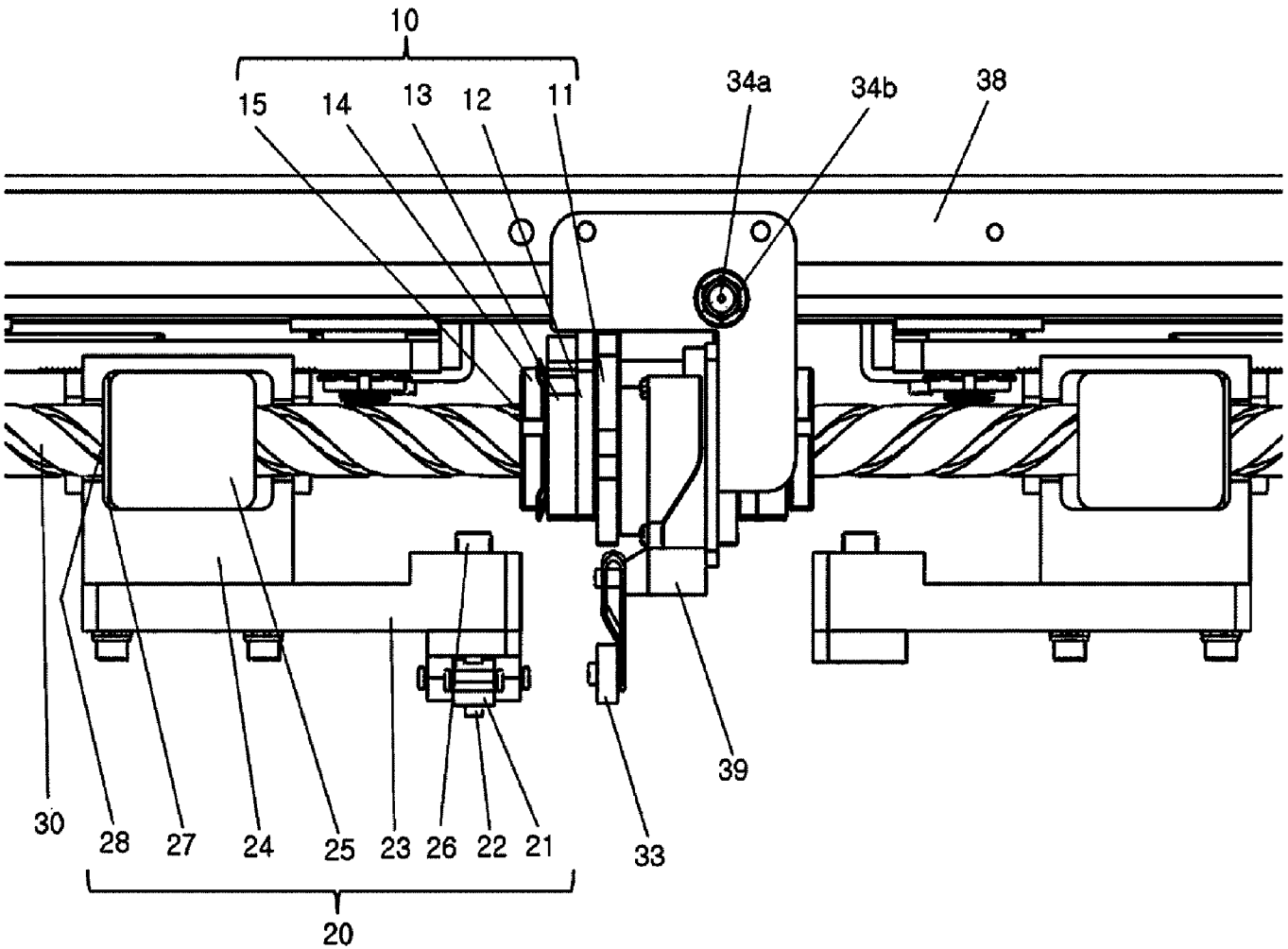
FIG. 16 is a plan view showing the electric door lock system of FIG. 13 when it was completely opened.
Figure 17:
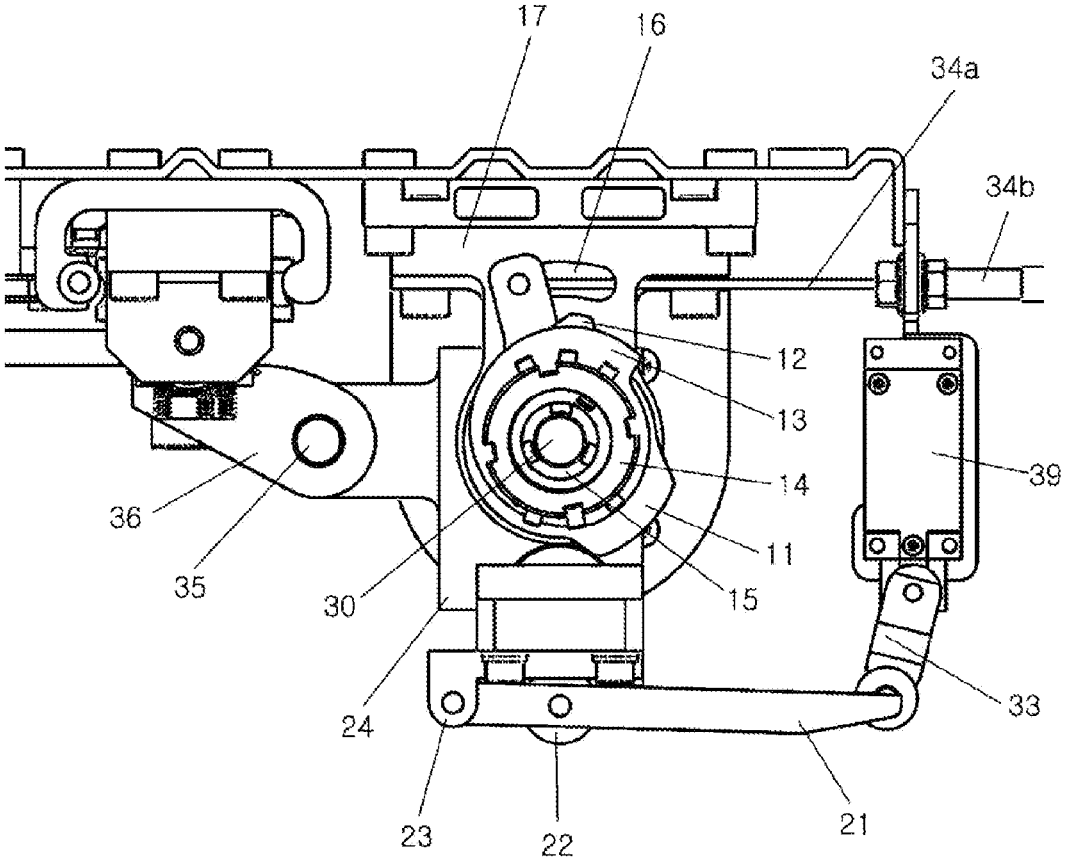
FIG. 17 is a side view showing the electric door lock system of FIG. 16 when it was completely opened.
Figure 18:
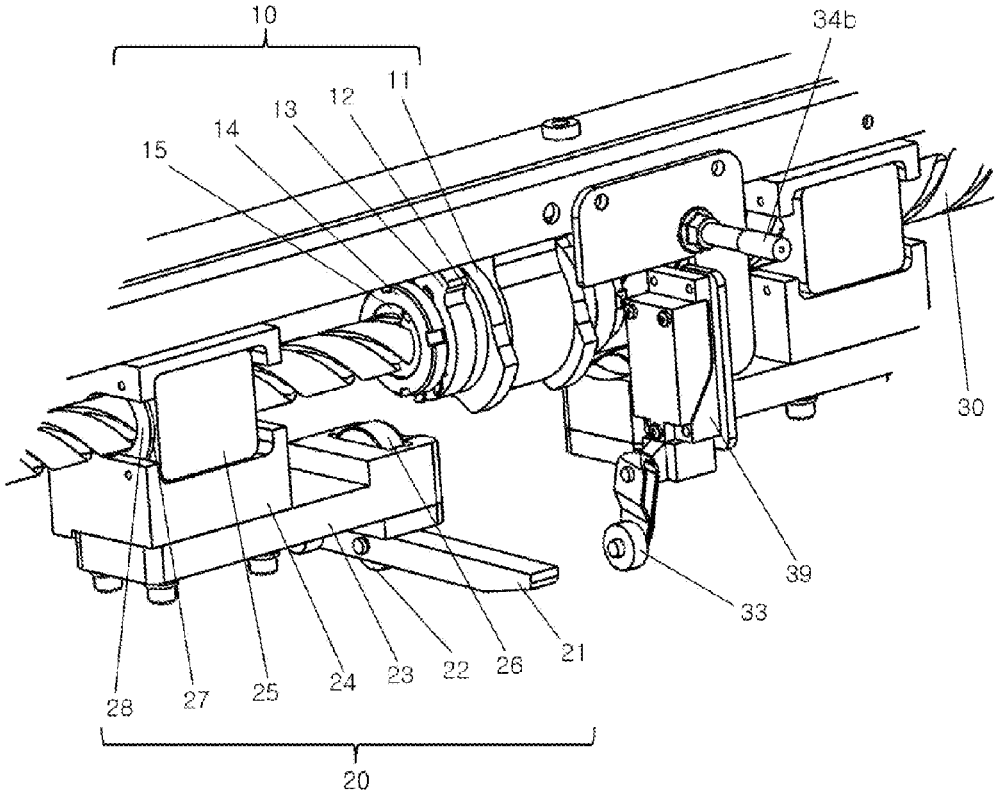
FIG. 18 is a perspective view showing the electric door lock system of FIG. 16 when it was completely opened.

FIGS. 10 to 12 are views showing the electric door lock system when it starts to perform an opening operation, FIGS. 13 to 15 are views showing the state of the electric door lock system being opened so that the locking roller is just unlatched from the locking cam of the cam block, and FIGS. 16 to 18 are views showing the electric door lock system when it was completely opened.

In order to open a door, the motor rotates in the direction opposite to the above-mentioned direction so that the screw 30 also rotates in the reverse direction. Here, as the screw 30 rotates, the sliding unit 20 is moved in the direction in which the door body is opened, so that the locking roller 26 cannot be moved out of the locked position in which the locking roller 26 latched onto the locking cam 13 of the cam block 10.

Thus, the space in which the screw nut 25 is moved in the direction along which the door body slides with respect to the screw nut housing 24 is further provided between the screw nut 25 and the screw nut housing 24. The space is formed such that if the screw 30 rotates in the reverse direction, when the unlocking cam 12 and the locking cam 13, other than the emergency-release cam 11, rotate and the screw nut 25 is moved in the direction in which the door body is opened, the sliding unit 20 is not moved, but held as it is while the screw nut 25 is moved by the range of the space in the screw nut housing 24. Here, the unlocking cam 12 that rotates together with the screw 30 pushes (presses) the locking roller 26 away from the cam block 10 (in the direction F shown in FIGS. 10 to 12), and therefore the locking function that is being performed between the locking roller 26 and the locking cam 13 is operated to be smoothly released, so that the door body can be normally opened.

Next, the emergency-release operation of the electric door lock system will be described with reference to FIGS. 19 to 21.

Figure 19:
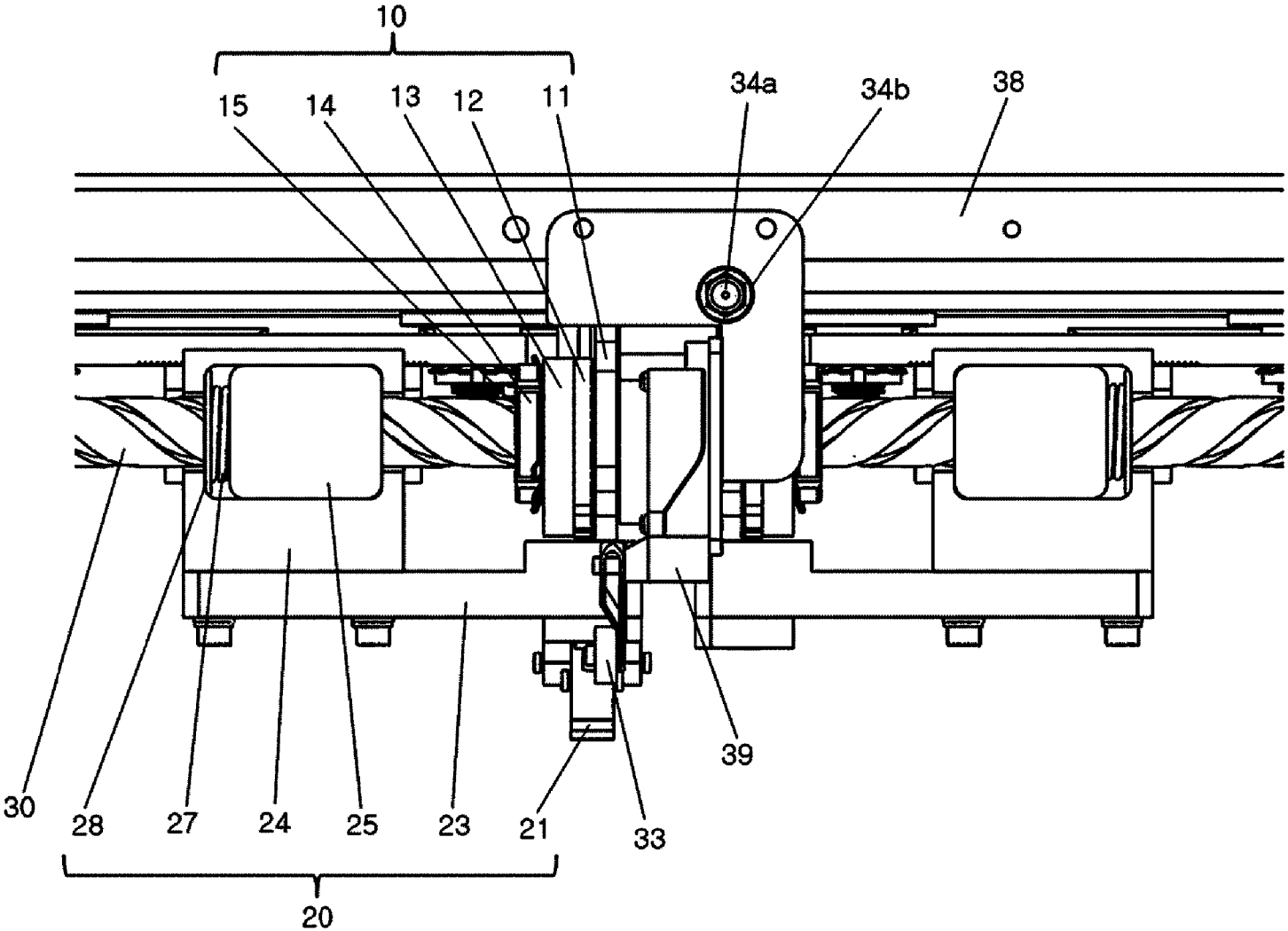
FIG. 19 is a plan view showing the electric door lock system when it is being emergency-released.
Figure 20:
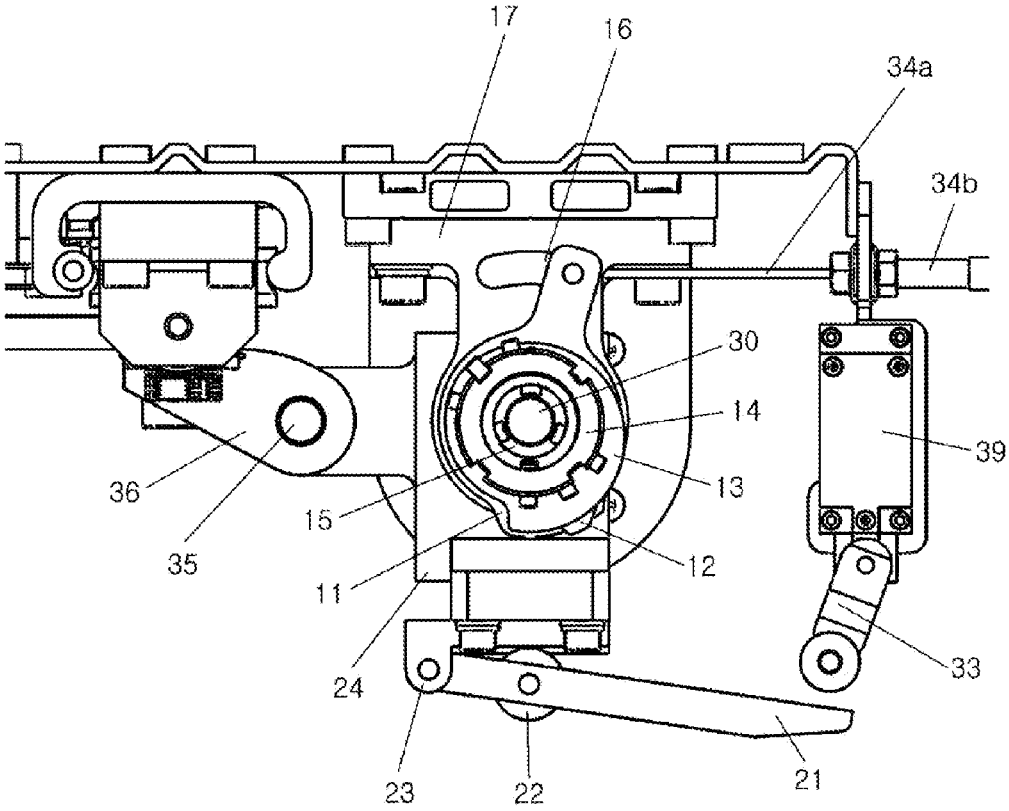
FIG. 20 is a side view showing the electric door lock system of FIG. 19 when it is being emergency-released.
Figure 21:
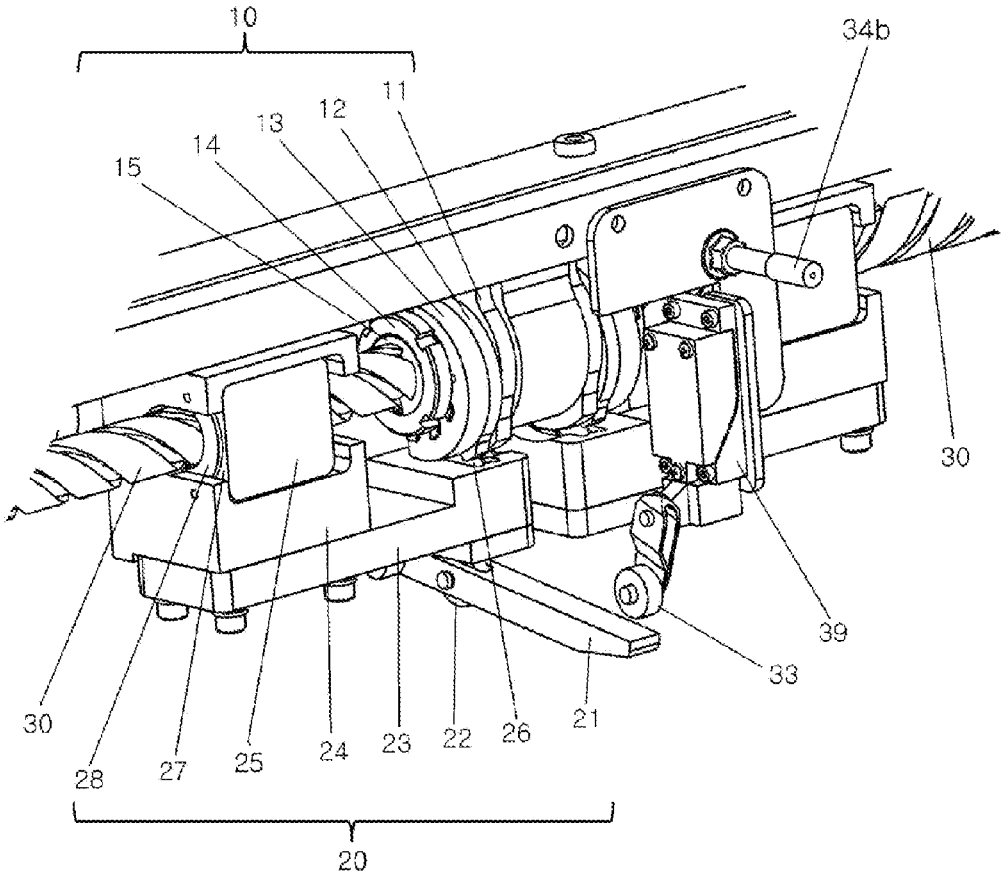
FIG. 21 is a perspective view showing the electric door lock system of FIG. 19 when it is being emergency-released.

FIG. 19 is a plan view showing the electric door lock system when it is being emergency-released, FIG. 20 is a side view showing the electric door lock system of FIG. 19, and FIG. 21 is a perspective view showing the electric door lock system of FIG. 19.

The emergency-release cam 11 is disposed at an innermost position of the cam block 10, and is only actuated by the operation wire 34*a* irrespective of the rotation of the screw 30. If a user tries to arbitrarily release the electric door lock system in an emergency state, when the operation wire 34*a* is pulled, one side of the emergency-release cam 11 connected with the operation wire 34*a* is moved by a certain distance along the long hole 16 of the cam housing 17 so that it is rotated at a certain angle. Here, a projected portion of the emergency-release cam 11 pushes the locking roller 26 away from the cam block 10, so that the locking roller 26 can be released from the locked position where it latched onto the locking cam 13.

Like this, according to the present embodiment, the electric door lock can have a simple structure, ensure the reliability of a locking function, reduce a danger of a failure and an operation error, and be easy to fabricate and maintain, saving the cost for the fabrication and maintenance relative to the cost taken in the related art.

In case of the above-mentioned embodiment, the locking switch 33, the screws 30, the cam block 10, and the sliding units 20 may be respectively provided in a pair unit, in which both elements are symmetric with each other, on the door frame 38. This is because the door body is provided in a pair unit such that both elements are opened or closed by being moved apart from or close to each other.

However, the scope of the present invention is not limited thereto, so a single door body can be provided in the door frame 38. In the case that the single door body is provided, it may suffice if the locking switch 33, the screw 30, the cam block 10, and the sliding unit 20 respectively are concurrently provided in a single piece. Of course, even through the single door body is provided on the door frame 38, the embodiment can also implement the same performance as the present embodiment.

The electric door lock according to the above embodiments of the present invention may be adapted to electric doors of railway trains, screen doors of subway stations, etc.

Although a preferred embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. An electric door lock system for an electric slidable door body, the electric door lock system comprising:

a screw rotatable forwards and rearwards and configured to be disposed in one side of a door frame in parallel with a direction in which the door body is slidable;

a cam block disposed on a certain position of the screw to provide lock and unlock functions; and a sliding unit having a locking roller elastically biased towards the cam block and configured to directly latch onto the cam block to provide the locking function, wherein one end of the sliding unit is rotatably connected to the screw and the other end of the sliding unit is configured to be connected to the door body;

wherein the cam block comprises:

a locking cam, which rotates together with the screw, configured to latch onto the locking roller to provide the locking function; and an unlocking cam, which rotates together with the screw, configured to push the locking roller away from the cam block to provide the unlock function, wherein the locking cam and the unlocking cam are placed next to each other;

wherein the sliding unit further comprises:

a screw nut rotatably engaged with the screw such that the screw nut is moved longitudinally along the screw when the screw and the screw nut are rotated relative to each other;

a screw nut housing externally surrounding and supporting the screw nut;

a spring, installed in parallel with the screw, which allows the screw nut to move freely inside the screw nut housing to a certain degree; and a spring support which prevents the spring from being dislocated from its position.

2. The electric door lock system according to claim 1, wherein the cam block further includes: an anti-release nut preventing the locking cam and the unlocking cam from being released; and a cam fixing shaft fixing the locking cam and the unlocking cam to the screw.

3. The electric door lock system according to claim 1, wherein the cam block is mounted on a central portion or an end of the screw.

4. The electric door lock system according to claim 1, wherein the cam block further includes an emergency-release cam configured, upon determination of an emergency state, to push the locking roller away from the cam block.

5. The electric door lock system according to claim 4, wherein the emergency-release cam is operatively connected with an operation wire.

6. The electric door lock system according to claim 1, further comprising:

a locking switch configured to be provided in the door body for checking a locked state of the door body when the door body is closed; and a locking switch pressing part configured to be actuated for the sliding unit to operate the locking switch such that a locking signal is generated by the locking switch when the door body is closed.

7. The electric door lock system according to claim 6, wherein the locking switch pressing part further includes a locking switch pressing roller.

8. The electric door lock system according to claim 1, wherein the sliding unit further includes a locking roller holder connected to one side of the screw nut housing and a locking switch pressing part.

9. The electric door lock system according to claim 8, wherein the screw nut housing has a space in which the sliding unit is prevented from moving until the screw nut that is moving as the screw rotates is moved to a certain distance.

10. The electric door lock system according to claim 8, wherein the sliding unit further includes:

a hanger configured to be connected with the door body;

a guide roller connected to one side of the hanger and configured to be coupled to a guide rail formed on the door frame such that the guide roller is rollable along the guide rail; and a link that connects and supports the other side of the hanger and the screw nut housing.

11. The electric door lock system according to claim 1, wherein the screw, the cam block, and the sliding unit are respectively provided in pair units, in which both units are symmetric with each other, for a corresponding pair of door bodies on the door frame.

12. The electric door lock system according to claim 1, wherein the screw has threads extending opposite to each other.

13. The electric door lock system according to claim 1, further comprising a closing switch configured to be provided in the door body so as to generate a signal indicative of a closed state of the door body when the door body is closed.

14. An electric door comprising the electrical door lock system according to claim 1.

* * * * *